US007506673B2

(12) United States Patent
Palmer

(10) Patent No.: US 7,506,673 B2
(45) **Date of Patent: *Mar. 24, 2009**

(54) MANUAL BULK LIQUID PUMP CONTROL AND DISTRIBUTION SYSTEM

(75) Inventor: David Palmer, Woodland, CA (US)

(73) Assignee: Safety Pumping Systems, LLC, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/534,945

(22) Filed: Sep. 25, 2006

(65) Prior Publication Data

US 2007/0062606 A1 Mar. 22, 2007

Related U.S. Application Data

(63) Continuation of application No. 10/893,053, filed on Jul. 16, 2004, now Pat. No. 7,124,792.

(51) Int. Cl.
*B65B 1/04* (2006.01)

(52) U.S. Cl. ..... 141/231; 141/286; 141/301; 137/205; 137/565.12; 417/231

(58) Field of Classification Search ..... 141/231, 141/301, 302, 286, 192, 98; 417/231; 137/627.5, 137/565.12, 899.4, 205
See application file for complete search history.

(56) References Cited

U.S. PATENT DOCUMENTS 2,800,365 A 7/1957 Hodges
3,544,010 A 12/1970 Jurdye
3,677,284 A 7/1972 Mendez
3,905,516 A 9/1975 Wisnia
3,971,400 A 7/1976 Thompson
4,131,214 A 12/1978 Rogers
4,177,017 A 12/1979 Schultz
5,529,098 A 6/1996 Bravo
5,967,174 A 10/1999 MacDonald
6,367,655 B1 * 4/2002 Haselden, Jr. ..... 222/1
6,499,670 B1 12/2002 Brown et al.
6,623,245 B2 9/2003 Meza et al.
6,945,288 B1 9/2005 Brakefield et al.

* cited by examiner

*Primary Examiner*—Steven O Douglas
(74) *Attorney, Agent, or Firm*—John P. O'Banion

(57) ABSTRACT

The present invention is directed to a manual bulk liquid pump control and distribution system that utilizes a single-handle manual operation for direction of flow and speed, along with providing a neutral position for standby. The system can be operated at a rate of 0 to 250 gallons per minute and be reversed with a single motion of the operating handle. The pump operates in one direction at a fixed RPM, resulting in longer pump life and safer operation. For added safety, the system utilizes the pump's relief valve for both discharge and suction operation. It has the ability of sucking the liquid out of the lines and hoses after each transfer operation. This system has an aluminum flow-reversing valve or two-way valve at the center of the design. This valve allows the flow of the product to be precisely controlled in either direction, along with the flow rate and pressure. This gives the operator the ability to control the product regardless of viscosity or volume. The system has been designed with pressure-tested manifolds and custom design brackets along with a sampling valve and an easily accessible angled strainer basket. The design allows for safe and convenient pump operation as well as for the proper handling of liquids during environmentally sensitive times.

21 Claims, 3 Drawing Sheets

MANUAL BULK LIQUID PUMP CONTROL AND DISTRIBUTION SYSTEM

CROSS-REFERENCE TO RELATED APPLICATIONS

This application is a continuation of application Ser. No. 10/893,053 filed on Jul. 16, 2004, now U.S. Pat. No. 7,124,792, which is incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

FIELD OF THE INVENTION

This invention relates to the field of controlling the directional flow of bulk liquids. Bulk liquids are generally held in large containment vessels to be stored or transported. This patent deals with the precise control and distribution of liquids from these containment vessels along with the capability of pumping liquid back into the containment vessel by the means of suction. Additionally this patent deals with a unique method of removing any excess liquid from the hoses and lines in the system to insure that no liquid is spilled on the ground or retained within the hoses.

Existing methods of pumping and siphoning bulk liquids has in the past been cumbersome where quantities of the liquid are left within the pump, hoses and distribution lines and this liquid is often spilled onto the ground. A great amount of the bulk liquid is in the form of chemicals, fuel and oil products that produce an environmental hazard when spilled. The Environmental Protection Agency (EPA) has endeavored to put strict regulations on the handling and spillage of these liquids. The petroleum tank and containment vessels are extremely regulated, but the pumping systems are not. No standard or performance windows have been made for the installation and capabilities of the pump systems presently in use.

BACKGROUND OF THE INVENTION

The new manual bulk liquid pump control and distribution system was designed primarily for the over the road petroleum transportation industry delivering to above the ground tanks, but it has been found to be useful in the handling of a wide variety of other bulk liquids. This patent is not intended be limited in its scope to the petroleum industry only, but has the capability to be effective in the handling of a variety of other bulk liquids. The new manual bulk liquid pump control and distribution system has been designed to revolutionize not only the way bulk liquids are handled by truck tankers but also the way bulk liquids are transferred between containment vessels. Bulk liquids in the petroleum industry consist of gasoline, oil, diesel, aviation-gas, and transmission fluid to anti-freeze, used oil, and more.

In environmentally sensitive areas such as coast lines, rivers, lakes, ski slopes, parks, wetlands, high water tables or any area where underground tanks cannot be used, there is zero tolerance of a contamination spill. Further, underground tanks must be specially designed, manufactured, installed and monitored to detect and prevent leaks. Accordingly, it is extremely expensive to put a tank underground. In these applications, they are filled by a gravity drop, and no pump is required to deliver fuel to these tanks.

Most corporate farms, businesses, municipalities, airports, rental car yards, trucking companies, construction companies, bus companies and railroads use above ground storage tanks. This style of tank requires a pump to fill them. The application of federal law requires like vehicles to respond to their own accidents and rollovers. In the case of the petroleum industry, if a vehicle is rolled over and lying on its side, the fuel must be removed before the vehicle is up-righted. The fuel is salvageable and requires a pump to remove it. The railroad locomotives are filled, and tank cars are loaded and unloaded with the use of pumps mounted on trucks. All package oil facilities that purchase bulk oils and package them for retail sale, use above ground tanks and require vehicles with pumps to fill them. All shipyards and container yards use above ground tanks, and they require pumps mounted on trucks to load and unload fuel on the tugs and tankers.

Presently, not all states are equal in their environmental requirements. California was the first state to have them, and consequently has the highest restrictions with respect to the handling and transportation of hazardous liquids. Many other states have followed suit with similar requirements and the EPA is now beginning to enforce these laws more diligently in all states. The possibility of a trucking company spilling fuel upon disconnecting of the hoses is being greatly scrutinized. There is no longer any tolerance for these types of frequent spills. The manual bulk liquid pump control and distribution system eliminates substantially all spillage in these zero spill environments.

As regulation of the industry continues to increase, more above ground fuel tanks will be installed to replace underground tanks, resulting in a dramatic increase in above ground pumping applications. Today in California, if you are a jobber that contracts to Chevron, you are required to have a pump installed on your truck to service their customers. That number is growing, and most all new tankers put into service in California will have pumps installed on them. As the agencies tighten the regulations and enforce the environmental laws, more pumps are required to meet the laws governing the above ground fuel storage and handling systems.

The fuel oil transportation industry and chemical transportation industry have problems that are similar to the petroleum industry. Tankers are no longer used as a single delivery of product to an underground tank and back to the refinery for another partial load. These vehicles and operators must be able to multi-task to survive. These include multiple deliveries per load, both gravity and pump loads, numerous drivers per vehicle, variable products, multitudes of tanks and vessels to deliver to, emergency responses, station pump outs, and railroad deliveries, all of which are just some of the different daily conditions. These are all done under the ever-growing scrutiny of the Environmental Protection Agency, Department of Transportation, and insurance industry.

The same environmental laws are now being enforced in international markets as well. Islands such as the Dominican Republic are converting to all above ground tanks and are changing their entire transport fleets. They are using a variety of pumps that are put on trucks with no forethought about problems that might be caused. Every single pump is unique and operates differently. This results in daily spills on each and every delivery, which is no longer an accepted practice.

The manual bulk liquid pump control and distribution system primarily designed for the petroleum transportation industry was built by the present inventor with safety and the environment at the forefront. The single flow reversing two-way valve handle controls the flow rate and volume of product and eases the stress of operation of this type of equipment. This design makes the unloading and loading of hazardous liquids as safe and efficient as possible along with the ability of removing all the liquid from the lines and hoses. The unique design meets the demands and the stringent requirements set by the Environmental Protection Agency, Air Resources Board, Department of Transportation, A.S.M.E, and various insurance companies.

REFERENCES CITED

U.S. Pat. No. 3,905,516, issuing to Jeffry A. Wisnia, describes a fuel oil truck pumping system, having control means for automatically raising and lowering the speed of the pump when the delivery hose nozzle is manually opened and closed. The truck has a large oil storage tank and a delivery hose with a nozzle. A pump is mounted on the truck to draw the fuel oil from the storage tank into the delivery hose. A spring-loaded valve is mounted in the outlet port of the pump and an actuator mechanism operates in response to valve movement to adjust the setting of the truck engine throttle, which controls the speed of the pump. Thus, when the hose nozzle is opened to initiate fuel delivery, the resulting pressure differential causes the valve to spring open and the pump to speed up. When the nozzle is closed, the resulting pressure equalization causes the valve to spring closed and the pump to then slow down.

This patent describes a fuel oil truck pumping system, having control means for automatically raising and lowering the speed of the pump. This system relies upon the speed of the pump to control the volume of the flow, and when the pump is turned off, it relies upon gravity to empty the hose. This system does not have the capability of drawing excess liquid from the hose, or drawing a liquid out of a container back into the truck container.

U.S. Pat. No. 4,131,214, issuing to Joe E. Rogers, describes an apparatus for pumping a flowable material from a tank disposed on an engine-powered vehicle. The invention is particularly adapted for use with a multiple compartment tank on a petroleum delivery truck. An air pump, which may be the air pump for operating the air brakes of the vehicle, is powered by the vehicle engine and pumps air into a surge tank where the air is held under pressure. A conduit leads from the surge tank to a manifold that is coupled with each of the compartments of the material storage tank. Each of the compartments is coupled with the common manifold through appropriate spur conduits. An appropriate pressure regulator means maintains the pressure on the surge tank and valve means that is operable to pass the air under pressure from the surge tank to one or more of the compartments thereby pumping the material from the storage tank.

This patent describes an apparatus for pumping a flowable material from a tank disposed on an engine-powered vehicle. This patent uses the air pump of the vehicle to pressurize the compartments pumping the material from the storage container. This patent describes a method of forcing a liquid out of a container but has no way of drawing a liquid back into the container from the hose or from another container.

U.S. Pat. No. 4,177,017, issuing to Jeffery A: Schultz, discloses a system that is used for pumping cryogenic liquids from delivery vehicles including trucks, semi-trailers and trailers. This system uses an internal combustion engine that is mounted at the forward end of the vehicle or, in the case of a trailer truck at the forward end of the trailer, and drives a variable displacement hydrostatic transmission that comprises a hydraulic pump driven directly from the output shaft of the internal combustion engine. The transmission also comprises a high-speed hydraulic motor coupled by hydraulic lines with the hydraulic pump and arranged in a closed loop system. The hydraulic motor is disposed at a rear end of the vehicle (trailer) and has its output shaft coupled directly to the cryogenic delivery pump of the vehicle. A control panel is mounted in a rear compartment of the vehicle and allows the operator to control, inter alia, engine speed, hydrostatic drive speed and cryogenic pump output pressure.

This patent describes a system that is used for pumping cryogenic liquids from delivery vehicles. The handling of cryogenic liquid like oxygen in this patent is far different from the handling of petroleum or similar products, and must use pressure regulating and controlling devices and thus does not fall within the scope of this patent.

U.S. Pat. No. 5,529,098, issuing to Sergio M. Bravo, tells of a containment box for collecting leaking gasoline from gasoline handling equipment, such as a gasoline dispenser that is disposed below the dispenser. The box receives a gasoline supply pipe passing through an aperture, and a fitting that is provided for sealing the aperture and adjustably fixing the supply pipe. The fitting includes a main body, a deformable element, and a seating piece for seating the deformable element and threaded to the main body, and a clamping piece threadable onto the seating piece to cam the deformable element radially inward to contact the supply pipe. In another embodiment, the main body and seating piece are combined unitarily. The box has another aperture through which a conduit passes, and there is a universal fitting for sealing that aperture. The universal fitting includes a main body with an external shoulder and a nut which threads onto the main body, with gaskets disposed between the shoulder and box and between the nut and box. The main body has an integrally formed internal shoulder for supporting sealing compound. The box has a further aperture for communicating with a vapor recovery pipe, and there is another universal fitting identical to the first for connecting with the pipe. There is also an underground terminator fitting for connecting two double-walled pipes to allow flow through the primary pipes, but prevent flow through the outer pipes.

This patent tells of a containment box for collecting leaking gasoline from gasoline handling equipment. This patent has nothing to do with the dispensing or removal of liquids from containment vessels, but does illustrate the difficulty in controlling the spillage and containment of petroleum products and the extents that are required to retain inadvertent spilling of these liquids.

U.S. Pat. No. 5,967,174, issuing to William David MacDonald, discloses an apparatus for removing and containing spills occurring upon filling of a delivery tank truck. The spill catching basin and more particularly the drains mounted to the tops of tanks are modified to deliver liquid spilled into the basin to a single outlet along the side of the truck. A receptacle, such as a buried tank is provided to receive the runoff from the truck. Provided for connection to the outlet is a fitting, which may be releasably clamped to the outside of the outlet. The fitting is coupled to the buried tank by a flexible hose and a slip coupling between the hose and the fitting.

This patent describes an apparatus for removing and containing spills occurring upon filling of a delivery tank truck. This patent deals more with the spillage of the liquid during the filling process rather than the dispensing process.

U.S. Pat. No. 6,623,245, issuing to Humberto V. Meza et al., tells of a method and apparatus for a pump and a pump control system. The apparatus includes pistons integrally formed in a diaphragm and coupled to the diaphragm by convolutes. These convolutes have a bottom surface angled with respect to a top surface of the pistons. The apparatus also includes an outlet port positioned tangentially with respect to the perimeter of an outlet chamber. The apparatus further includes a non-mechanical pressure sensor coupled to a pump control system. For the method of the invention, the micro controller provides a pulse-width modulation control signal to an output power stage in order to selectively control the power provided to the pump. The control signal is based on the pressure within the pump, the current being provided to the pump, and the voltage level of the battery.

This patent describes a method and apparatus for a pump and a pump control system. This is a sophisticated pump and control circuit, but does not offer the capabilities of the two-way valve system where a pump running at a constant speed can both control the volume and pump liquid in either direction from two containment vessels.

None of the foregoing prior art teaches or suggests the particular unique features of the manual bulk liquid pump control and distribution system. This clarifies the need for further improvements in the devices that can transfer bulk liquids and still meet the high standards set by the Environmental Protection Agency, Department of Transportation, the Air Resources Board and the insurance companies.

In this respect, before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

OBJECTS OF THE INVENTION

The principal object of the manual bulk liquid pump control and distribution system is to create a unique system that will eliminate substantially all spillage of liquids during the transfer from one containment vessel to a second containment vessel.

Another object of the manual bulk liquid pump control and distribution system is to create a unique way to move bulk liquids in two different directions through a single flow reversing two-way valve without reversing the direction of the pump drive unit.

Another object of the manual bulk liquid pump control and distribution system is to create a unique manual system that will control the flow rate and volume of bulk liquids in either direction while the pump is operating at a constant speed with a single valve handle and no electronic control devices.

Another object of the manual bulk liquid pump control and distribution system is to create a small and compact unit which is easily accessible to an operator.

Another object of the manual bulk liquid pump control and distribution system is to create a system with a crossover line that will access from both sides of a vehicle.

Yet another object is to create a manual bulk liquid pump control and distribution system that can be put in a neutral position where no liquid is pumped in either direction with the pump using it's relief valve still running at a constant speed.

And yet, another object is to create a manual bulk liquid pump control and distribution system where the liquid is always forced through the strainer basket in the same direction whether the system is in the discharge or suction mode.

And still another object is to create a manual bulk liquid pump control and distribution system where the strainer basket in the angled strainer basket housing is easily accessible and will not spill liquid when the access port is opened.

A further object of this invention is to create a unique system that is adaptable to a variety of different configurations.

A final object of this invention is to add a new and unique system to the area of transferring bulk liquids from one containment vessel to a second containment vessel while meeting all the new stringent requirements set forth by the Environmental Protection Agency, Department of Transportation, the Air Resources Board and the insurance companies.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

SUMMARY OF THE INVENTION

The unique feature of this invention is the compact features and the simplicity of how it operates along with the ability of solving many of the problems of handling bulk petroleum and other similar products where spills have become an ever-present and dangerous environmental problem.

The present invention is directed to a manual bulk liquid pump control and distribution system that utilizes a single-handle flow reversing two-way valve for the operational direction of flow and volume, while providing a neutral position for standby. The pump drive will generally be by the means of a clutch-type power takeoff (PTO) from the vehicle engine or an auxiliary engine mounted on the vehicle or on a pallet as a portable device. The system can be operated at a rate of 0 to 250 gallons per minute and be reversed and controlled with a single motion of the operating handle on the flow reversing two-way valve.

The pump operates in one direction at a fixed RPM, resulting in longer pump life and safer operation. For added safety, the system utilizes the pump's relief valve for both loading and unloading. It must be understood that a variety of different pumps made by different manufactures will perform the same function of pumping the liquid and remain within the scope of this patent. Since the system has a neutral position when the PTO is engaged, no fluid motion or pressure develops until the system gradually begins to operate after all connections are verified by the operator. When the liquid has been transferred, the residue liquid left in the lines and hoses may be removed by raising the end of the hose up trapping the liquid and manually reversing the flow reversing two way valve to the suction position.

This system has an aluminum flow reversing two-way valve at the center of the design. The valve allows the flow of the product to be precisely controlled in either direction, along with flow rate and pressure. This gives the operator the ability to control the product regardless of viscosity or volume. The system has been designed with pressure-tested manifolds and custom design brackets along with a sampling valve. A crossover line is easily adapted to the system making easy access to both sides of a vehicle. The design allows for the safest pump operation available for proper handling of a wide variety of products during these environmentally sensitive times.

The system incorporates an easily accessible strainer basket housed within a strainer basket housing that is inclined so that when the strainer basket cover plate is removed the liquid within does not spill out. An extended handle positions the basket within the chamber so that the flow inters the center of the basket and the cover plate is easily accessible. A unique 110-degree elbow connects the strainer basket housing to the pump positioning the flow reversing two-way valve and valve handle in a convenient and easily accessible location and keeping the system as compact as possible. The strainer basket and housing is designed independently of the particular pump being used making it universal and adaptable to a wide variety of pump configurations.

With respect to the above description then, it is to be realized that the optimum dimensional relationships for the parts of the invention will include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In addition, it is to be understood that the phraseology and terminology employed herein are for the purpose of description and should not be regarded as limiting.

BRIEF DESCRIPTION OF THE DRAWING(S)

The accompanying drawings, which are incorporated in and form a part of this specification, illustrate embodiments of the invention and together with the detailed description, serve to explain the principles of this invention.

DETAILED DESCRIPTION OF THE PREFERRED EMBODIMENTS

Figure 1:
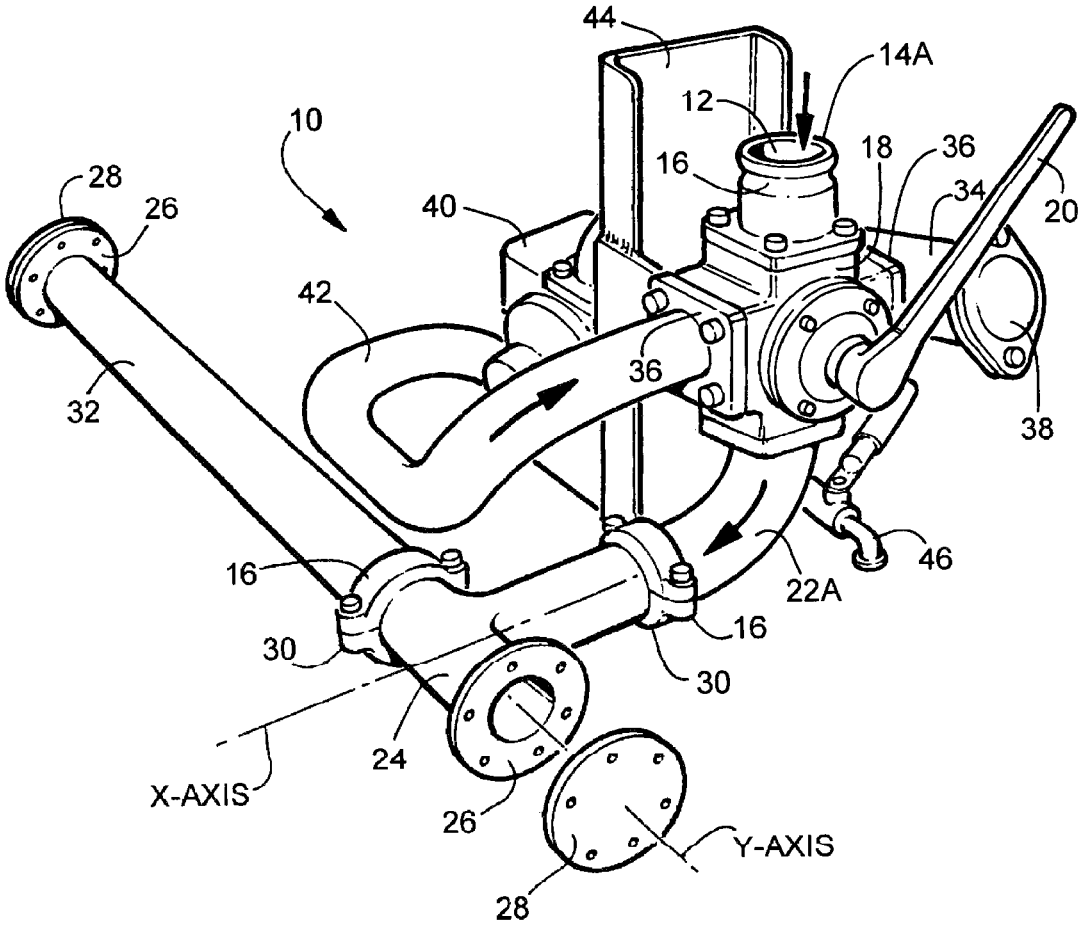
FIG. 1 depicts a perspective view of the left side of the manual bulk liquid pump control and distribution system illustrating the directional discharge flow of the bulk liquid with the intake orifice at the top and the discharge at the bottom.

For a fuller understanding of the nature and objects of the invention, reference should be had to the following detailed description taken in conjunction with the accompanying drawings which are incorporated in and form a part of this specification, illustrating embodiments of the invention and together with the description, serve to explain the principles of this invention. There is seen in FIG. 1 a perspective view of the left side of the manual bulk liquid pump control and distribution system 10. This view illustrates the directional discharge flow of the bulk liquid with arrows having the intake orifice 12 in the flanged coupling 14A with a flexible victaulic coupling means 16 at the top of the flow reversing two-way valve 18. The flow reversing two-way valve 18 is shown with the valve handle 20 to the right in the discharge position. At the bottom of the flow reversing two-way valve 18, the discharge is made through a 90-degree elbow 22 connected to a T-section 24 having two flexible victaulic coupling means 16, a conventional mounting flange 26 and cover plate 28. The flexible victaulic coupling means 16 uses an o-ring seal with a two-piece clamp ring 30 to give a sealed coupling that is similar to a ball joint type of flexible connection. One or more of these victaulic coupling means 16 or similar flexible sealed connecting means may be used on or between the lines or fittings in this system for flexibility and still remain within the scope of this patent. Coupled to the T-section 24 is a crossover line 32 having a similar conventional flange 26 and cover plate 28. The flexible victaulic coupling means 16 between the 90-degree elbow 22 and the T-section 24 allows flexibility along the X-axis parallel to the frame of the vehicle. The flexible victaulic coupling means 16 between the T-section 24 and the crossover line 32 allows flexibility along the Y-axis perpendicular to the frame of the vehicle. The angled strainer basket housing 34 is shown attached to the right side of the flow reversing two-way valve 18 by the means of a square-mounting flange 36. The strainer basket housing 34 has a cover plate 38. The conventional pump 40 is shown at the rear with an inter-connecting line 42 attached to the left side of the reversing two-way valve 18 by the means of a square-mounting flange 36. A pump mounting bracket 44 is attached to the conventional pump 40, the flow reversing two-way valve 18 and the frame of the vehicle supporting the assembly. A sampling and pump drain valve 46 are shown on the lower right side.

Figure 2:
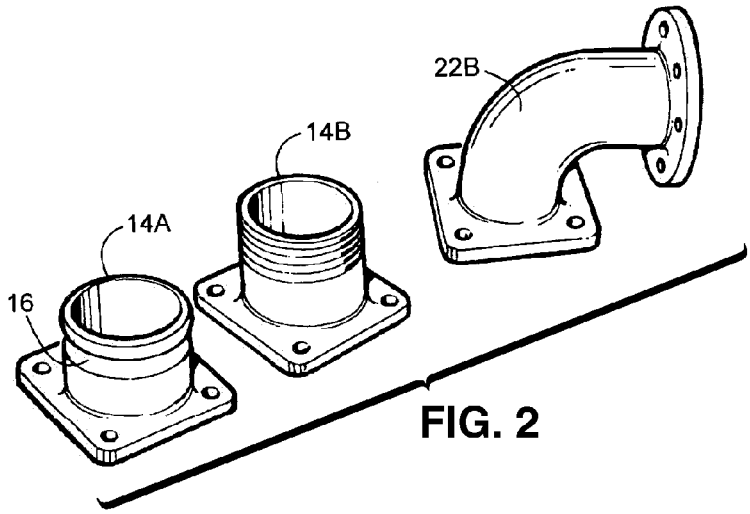
FIG. 2 depicts a perspective view of a variety of different couplings that can be used to adapt the manual bulk liquid pump control and distribution system into different configurations.

FIG. 2 depicts a perspective view of a variety of different couplings that can be used to adapt the manual bulk-liquid pump control and distribution system 10 into different configurations. The first fitting on the left is the flanged coupling 14A with the flexible victaulic coupling means 16. The second fitting is a threaded flanged coupling 14B. The third is a flanged elbow 22B, to be used when the crossover line 32 is not desired.

Figure 3:
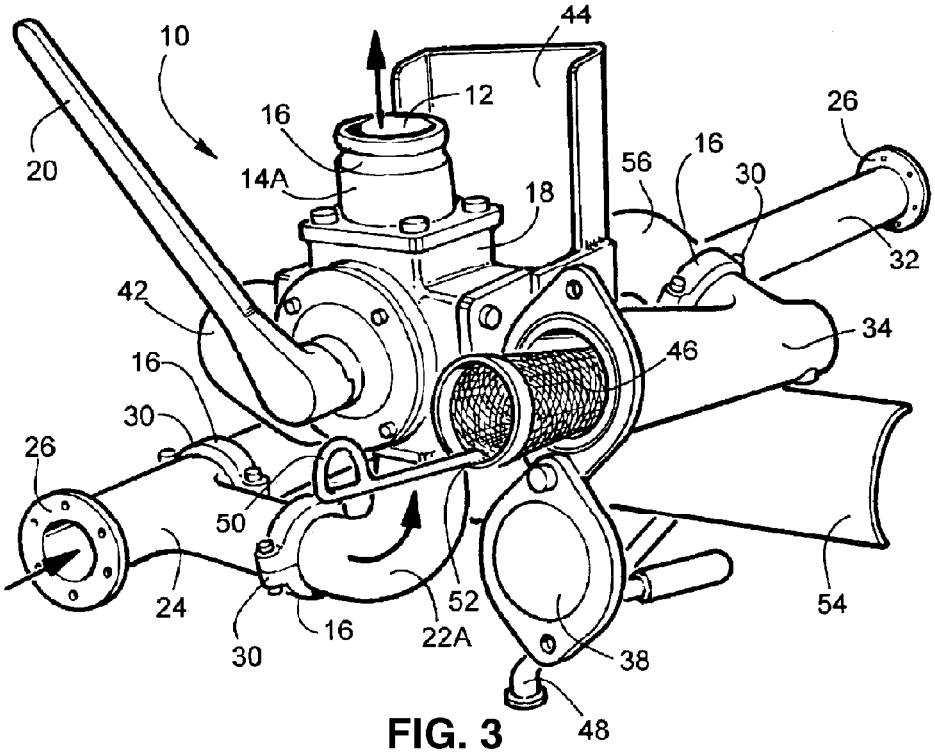
FIG. 3 depicts a perspective view of the right side of the manual bulk liquid pump control and distribution system illustrating the directional suction flow of the bulk liquid along with the strainer basket partly removed from the strainer housing.

FIG. 3 depicts a perspective view of the right side of the manual bulk liquid pump control and distribution system 10 illustrating the directional suction flow of the bulk liquid along with the strainer basket 48 partly removed from strainer basket housing 34. The extended handle 50 mounted on the lip 52 of the strainer basket 48 extends the strainer basket housing 34 forward increasing the accessibility to the cover plate 38. Note at this point that no matter whether the flow reversing two-way valve 18 is in the discharge or suction mode that the liquid always passes through the strainer basket 48 in the same direction. At the right is a half-round shield 54 for the drive coupling on the power take off.

Figure 4:
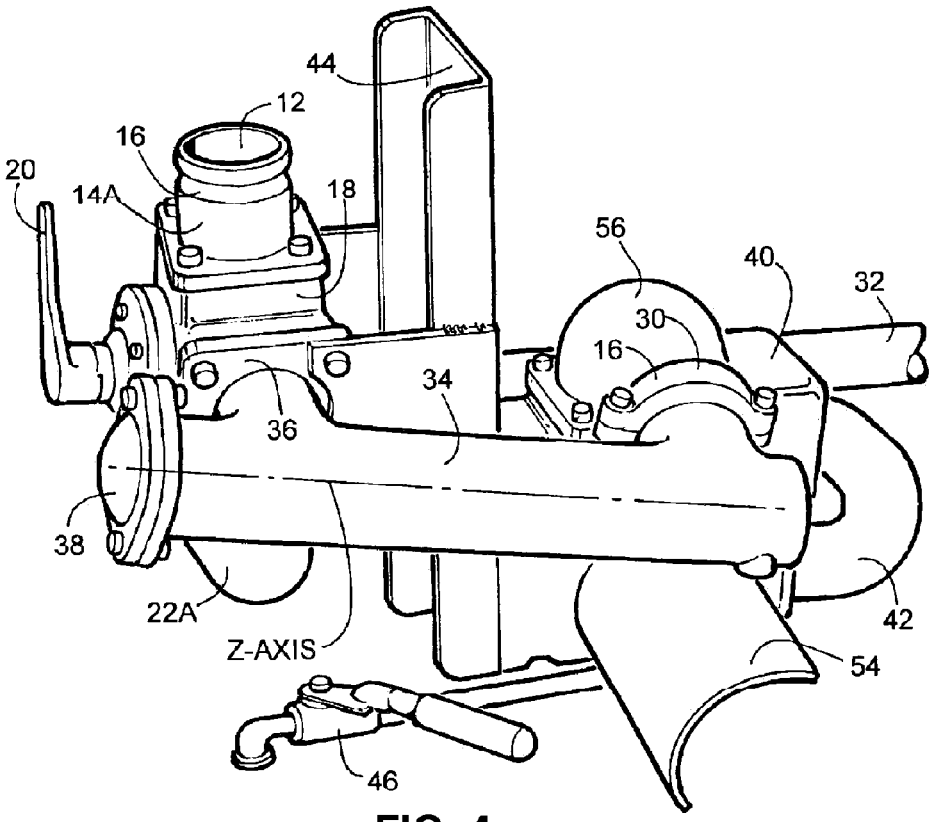
FIG. 4 depicts a perspective side view of the manual bulk liquid pump control and distribution system illustrating the inclined angle of the strainer basket housing.

FIG. 4 depicts a perspective side view of the manual bulk liquid pump control and distribution system 10 illustrating the inclined angle along the Z-axis of the strainer basket housing 34 eliminating spillage when the cover plate 38 is opened for cleaning of the strainer basket 48. A unique angled elbow 56 is used to make the connection between the strainer basket housing 34 and the conventional pump 40 positioning the flow reversing two-way valve 18 and valve handle 20 in a convenient location and keeping the system as compact as possible. The elbow 56 may be custom made with a flange and an angle to fit a variety of different brand name pump specifications. In the preferred embodiment as shown, the elbow 56 is angled at 110-degrees, however many other configurations are anticipated depending on the particular pump used. Similarly, the flange on the inter-connecting line 42 is custom designed to fit the particular pump 40 used.

Figure 5:
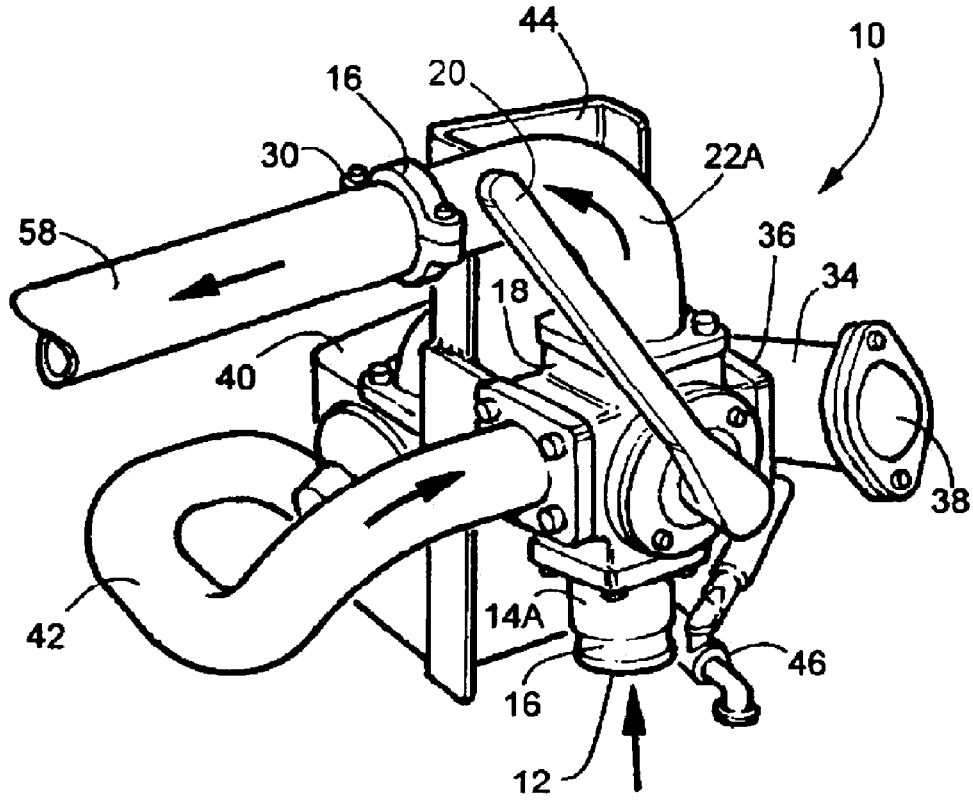
FIG. 5 depicts a perspective view of the left side of the manual bulk liquid pump control and distribution system illustrating one of the alternate configurations with the intake orifice at the bottom and the discharge at the top.

FIG. 5 depicts a perspective view of the left side of the manual bulk liquid pump control and distribution system 10 illustrating one of the alternate configurations with the intake orifice 12 in the flanged coupling 14A at the bottom of the flow reversing two way valve 18. The discharge through the 90-degree elbow 22 is at the top with a pipeline 58 going parallel to the frame to the back of the vehicle.

Figure 6:
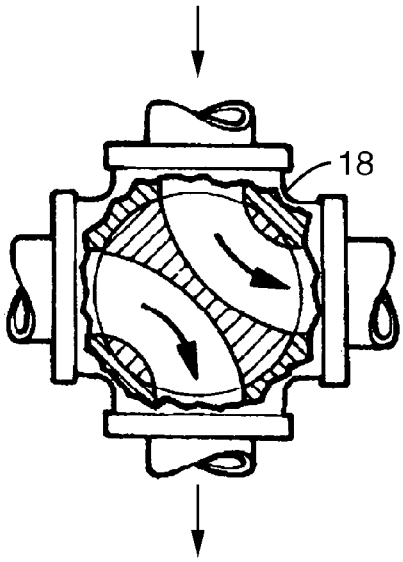
FIG. 6 depicts a side elevation of the conventional flow reversing two-way valve with the side cut away illustrating the flow in the discharge configuration.

FIG. 6 depicts a side elevation of the conventional flow reversing two-way valve 18 with the side cut away illustrating the flow in the discharge configuration.

Figure 7:
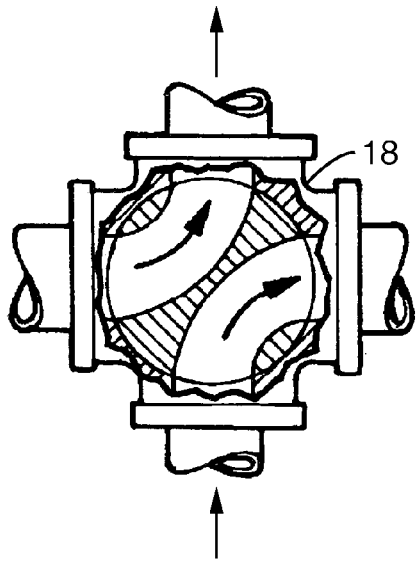
FIG. 7 depicts a side elevation of the conventional flow reversing two-way valve with the side cut away illustrating the flow in the suction configuration.

FIG. 7 depicts a side elevation of the conventional flow reversing two-way valve 18 with the side cut away illustrating the flow in the suction configuration.

The manual bulk liquid pump control and distribution system 10 shown in the drawings and described in detail herein disclose arrangements of elements of particular construction and configuration for illustrating preferred embodiments of structure and method of operation of the present invention. It is to be understood, however, that elements of different construction and configuration and other arrangements thereof other than those illustrated and described may be employed for providing a manual bulk liquid pump control and distribution system 10 in accordance with the spirit of this invention. Such changes, alternations and modifications as would occur to those skilled in the art are considered to be within the scope of this invention as are broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application that is measured by the claims, nor is it intended to be limiting as to the scope of the invention in any way.

What is claimed is:

1. An apparatus for distributing a liquid, coupled to a pump having an inlet and an outlet, comprising:

a flow reversing valve fluidly coupled to the inlet and the outlet of said pump;

said flow reversing valve having a first orifice and a second orifice;

said reversing valve further having a first position and a second position;

wherein when said flow reversing valve is in said first position, said pump moves liquid from said first orifice to said second orifice;

wherein when said flow reversing valve is in said second position, said pump moves liquid from said second orifice to said first orifice;

a strainer housing coupled to the inlet of said pump; and a strainer basket positioned in said strainer housing;

wherein said strainer housing is fluidly coupled to said flow reversing valve.

2. An apparatus as recited in claim 1:

wherein said first orifice is adapted to couple to a first containment vessel; and wherein said second orifice is adapted to couple to a second containment vessel.

3. An apparatus as recited in claim 1:

wherein said flow reversing valve has a third position; and wherein when said flow reversing valve is in said third position, no fluid motion is developed between said first orifice and said second orifice.

4. An apparatus as recited in claim 3, wherein there is no pressure difference between said first orifice and said second orifice when said flow reversing valve is in said third position and said pump is operating.

5. An apparatus as recited in claim 3:

wherein liquid flows at a first flow rate when said flow reversing valve is in said first position; and wherein a change in position of said flow reversing valve between said first position and said third position changes the flow rate of liquid flowing between said first orifice and said second orifice to a second flow rate less than said first flow rate and greater than zero.

6. An apparatus as recited in claim 4, wherein a change in position of said flow reversing valve between said first position and said third position changes the liquid pressure difference between said first orifice and said second orifice.

7. An apparatus as recited in claim 1, wherein liquid flows in one direction through said strainer basket when the position of said flow reversing valve is changed between said first position and said second position.

8. An apparatus as recited in claim 1, further comprising:

an inlet cover coupled to said strainer housing;

wherein said strainer housing is inclined so that said inlet cover can be removed to access said strainer basket without spilling liquid from said strainer housing.

9. An apparatus as recited in claim 1, wherein said pump does not reverse direction when flow direction of liquid is reversed by said flow reversing valve.

10. An apparatus as recited in claim 1, further comprising:

a hose having first and second ends, said first end coupled to said second orifice;

wherein said hose is adapted to retain residual liquid when said second end is raised above said second orifice; and wherein changing the position of said flow reversing valve from said first position to said second position removes retained residual liquid from said hose.

11. An apparatus as recited in claim 1:

wherein said flow reversing valve is mounted to a vehicle; and wherein said second orifice is fluidly coupled to a crossover line that will access liquid from both sides of said vehicle.

12. An apparatus as recited in claim 11:

wherein said first orifice is adapted to couple to a first containment vessel mounted on said vehicle; and wherein said crossover line is adapted to couple to a second containment vessel.

13. An apparatus as recited in claim 11:

wherein said flow reversing valve has a third position; and wherein when said flow reversing valve is in said third position, no liquid flows between said first orifice and said second orifice.

14. An apparatus as recited in claim 11, further comprising:

a hose having first and second ends, said first end coupled to said crossover line;

wherein said hose is adapted to retain residual liquid when said second end is raised above said crossover line; and wherein changing the position of said flow reversing valve from said first position to said second position removes retained residual liquid from said hose.

15. An apparatus for distributing a liquid comprising:

a pump having an inlet and an outlet, a flow reversing valve coupled to said inlet and said outlet of said pump;

said flow reversing valve having a first orifice and a second orifice;

said reversing valve further having a first position and a second position;

wherein when said flow reversing valve is in said first position, said pump moves liquid from said first orifice to said second orifice;

wherein liquid flows at a first flow rate when said flow reversing valve is in said first position;

wherein when said flow reversing valve is in said second position, said pump moves liquid from said second orifice to said first orifice;

wherein said flow reversing valve has a third position;

wherein when said flow reversing valve is in said third position, no liquid flows between said first orifice and said second orifice;

wherein a change in position of said flow reversing valve between said first position and said third position changes the flow rate of liquid flowing between said first orifice and said second orifice to a second flow rate less than said first flow rate and greater than zero.

16. An apparatus as recited in claim 15, wherein there is no pressure difference between said first orifice and said second orifice when said flow reversing valve is in said third position.

17. An apparatus as recited in claim 15, further comprising a pump drain valve coupled to said pump.

18. An apparatus as recited in claim 15, wherein said pump is a constant speed pump.

19. An apparatus as recited in claim 15, further comprising a pressure relief valve fluidly coupled between said inlet and said outlet of said pump.

20. An apparatus as recited in claim 19, further comprising a pump drain valve coupled to said pump.

21. An apparatus as recited in claim 15, further comprising:

a hose having first and second ends, said first end coupled to said second orifice;

wherein said hose is adapted to retain residual fluid when said second end is raised above said second orifice; and wherein changing the position of said flow reversing valve from said first position to said second position removes retained residual fluid from said hose.

* * * * *